US005573687A

United States Patent [19]

Tanaka

[11] Patent Number: 5,573,687

[45] Date of Patent: Nov. 12, 1996

[54] FIBROUS ELECTRIC CABLE ROAD HEATER

[75] Inventor: Kunio Tanaka, Ibaraki, Japan

[73] Assignee: Teijin Limited, Osaka, Japan

[21] Appl. No.: 398,083

[22] Filed: Mar. 3, 1995

[30] Foreign Application Priority Data

May 13, 1994 [JP] Japan ..... 6-005165 U

[51] Int. Cl.[6] ..... H05B 1/00

[52] U.S. Cl. ..... 219/213; 219/549; 338/214; 338/208

[58] Field of Search ..... 219/213, 545, 219/549, 528, 529; 338/214, 259, 208; 174/102 R, 109, 126.1, 173 C

[56] References Cited

U.S. PATENT DOCUMENTS

| | | | |
|---|---|---|---|
| 2,387,995 | 3/1944 | Huck | 338/214 |
| 3,366,912 | 1/1968 | Hubbuch | 219/545 |
| 4,100,673 | 7/1978 | Leavines | 219/528 |
| 4,195,805 | 4/1980 | Keep | 174/109 |
| 4,600,805 | 7/1986 | Glynn et al. | 174/102 R |
| 4,956,524 | 9/1990 | Karkow | 174/117 |

FOREIGN PATENT DOCUMENTS

| | | | |
|---|---|---|---|
| 505936 | 9/1992 | European Pat. Off. | 219/549 |
| 49-114232 | 10/1974 | Japan . | |
| 63-65704 | 4/1988 | Japan . | |
| 5-78157 | 10/1993 | Japan . | |
| 901531 | 7/1962 | United Kingdom | 219/213 |

*Primary Examiner*—Tu Hoang
*Assistant Examiner*—Karl Easthom
*Attorney, Agent, or Firm*—Armstrong, Westerman, Hattori, McLeland & Naughton

[57] ABSTRACT

A road heater comprising (1) a linear heater which is comprised of a linear heating element and a flexible electrically insulating layer formed on the entire periphery of the linear heating element, and (2) an outer textile structure such as a braid which covers the entire periphery of the linear heater. The road heater has a compressive yield load (Lc) of at least 1,000 kg. The outer textile structure is made of a thermoplastic synthetic fiber, preferably, a polyester monofilament, having a melting point of at least 200° C. and a single fiber fineness of at least 1,000 deniers. The linear heating element preferably comprises a flexible heat-generating mixed spun yarn composed of stainless steel fibers and heat-resistant electrically non-conductive fibers.

9 Claims, 2 Drawing Sheets

FIBROUS ELECTRIC CABLE ROAD HEATER

BACKGROUND OF THE INVENTION (1) Field of the Invention

This invention relates to a road heater used for making warm enough to melt and remove snow on the road.

(2) Description of the Related Art

Heretofore, a warm water-circulating system and an underground water spraying system have been widely employed for melting snow on the road or in other places. In recent years, an electrical road-heating system has become popular because of ease in laying and maintenance.

The heating element used in the electrical road-heating system is a linear heating element comprising a nichrome wire or a carbon heating element, which is covered with a thermal-resistant vinyl chloride resin insulator (Japanese Unexamined Patent Publication No. 49-114232 and Japanese Unexamined Utility Model Publication No. 63-65704). The linear heating element has problems such that the covering insulator thereof has a poor thermal resistance and a poor flexibility, and, when stressed in the radial direction, it is liable to be distorted in the radial direction.

These problems lead to the following disadvantages.

(i) To avoid damage of the covering insulator of the heating element, an asphalt mortar composition which is free from crushed stones must be laid instead of an asphalt concrete, composition which is a mixture of asphalt and crushed stones. However, the strength of the road surface as paved with the asphalt mortar composition is low as compared with the strength of that as paved with the asphalt concrete composition.

(ii) When an asphalt mortar composition is used, the pavement of roadbed must be conducted after the asphalt mortar composition is allowed to cool to about 120° C. This is time-consuming. Further, as the laid-asphalt mortar composition is pressed and smoothed by a roller at a relatively low temperature, it is difficult to strengthen the paved roadbed to the desired extent.

(iii) A substantially long time is required for pressing and smoothing the asphalt mortar composition laid on the roadbed because the asphalt mortar composition is rolled at a relatively low temperature. Thus the total time required for the completion of pavement is very long, which spans from the cooling of the hot asphalt mortar composition to the completion of pressing and smoothing the laid-asphalt mortar composition.

SUMMARY OF THE INVENTION

A primary object of the present invention is to obviate the problems of the conventional road heaters and to provide a road heater which has an excellent thermal resistance. Due to the high thermal resistance, when the roadbed is paved after the road heaters are laid thereon, any kinds of asphalt composition and any paving procedure can be employed and an asphalt concrete composition maintained at a high temperature can be applied as it is, and thus, the pavement can be completed within a short time and the paved road surface has a high strength.

In accordance with the present invention, there is provided a road heater comprising (1) a linear heater which is comprised of a linear heating element and a flexible electrically insulating layer formed on the entire periphery of the linear heating element, and (2) an outer textile structure which covers the entire periphery of the linear heater; said road heater having a compressive yield load (Lc) of at least 1,000 kg; and said outer textile structure is made of a thermoplastic synthetic fiber having a melting point of at least 200° C. and a single fiber fineness of at least 1,000 deniers.

Preferably, the linear heating element comprises a flexible heat-generating mixed spun yarn which is composed of 20 to 80% by weight of stainless steel fibers having a limited length and 80 to 20% by weight of heat-resistant electrically non-conductive fibers having a limited length and which is capable of generating heat due to contact resistance among the stainless steel fibers when an electric current is applied thereto. The linear heating element is preferably in the form of (1) a textile structure such as a braid which is formed on the periphery of a flexible continuous core material and which is fabricated from the flexible heat-generating spun yarn alone or a combination of the flexible heat-generating spun yarn with a flexible heat-resistant electrically non-conductive yarn, or (2) a single yarn composed of the flexible heat-generating spun yarn or a paralleled yarn composed of two or more of the flexible heat-generating spun yarns. The outer textile structure is preferably a braid fabricated from the thermoplastic synthetic fiber which is preferably a polyester monofilament.

DESCRIPTION OF THE PREFERRED EMBODIMENTS

The road heater of the present invention will now be described in detail with reference to the accompanying drawing.

Figure 1:
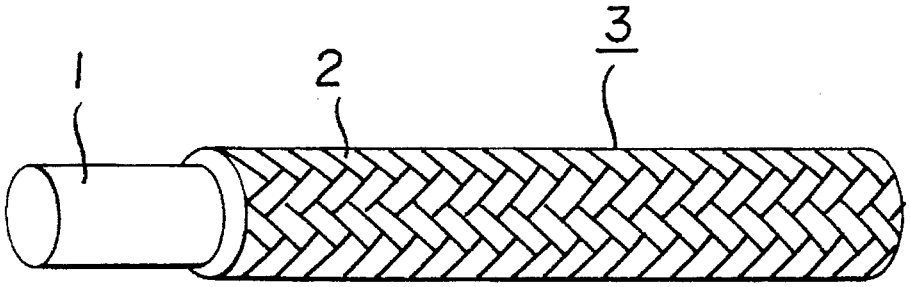
FIG. 1 is a perspective view of one example of the road heater of the present invention.

Referring to FIG. 1 which is a perspective view of one example of the road heater of the present invention, this road heater 3 is made by covering the periphery of a linear heater 1 with an outer textile structure 2 such as a braid made of polyester monofilaments having a single fiber fineness of at least 1,000 deniers. The linear heater 1 is composed of a linear heating element and a flexible electrically insulating layer formed on the entire periphery of the linear heating element (the linear heating element and the insulating layer are not shown in FIG. 1).

The linear heater 1 enables the road heater 3 to be laid in any desired configuration when embedded in the road. The material and structure of the linear heating element are not particularly limited, provided that it is capable of generating heat. As the linear heating element, there can be mentioned, for example, a nichrome wire heating element, a carbon heating element, and a flexible heat-generating mixed spun yarn which is composed of 20 to 80 weight % of stainless steel fibers having a limited length and 80 to 20 weight % of heat-resistant electrically non-conductive fibers having a limited length and which is capable of generating heat due to contact resistance among the stainless steel fibers when an electric current is applied. Of these linear heating elements, the flexible heat-generating mixed spun yarn is preferable because of a good resistance to a compressive force and a good efficiency of heat-generation.

The stainless steel fibers having a limited length used in the flexible heat-generating mixed spun yarn are obtained by stretch-cutting continuous stainless steel filaments having a volume resistivity of about $10^{-5}$ to $10^{-6}$ ohm.cm into short lengths. The stainless steel fibers preferably have a diameter of about 4 to 30 μm. If the diameter of the stainless steel fibers is too large, the heat-generating spun yarn has a poor flexibility. If the diameter thereof is too small, the stainless steel fibers are easily broken and the heat-generating mixed spun yarn has a poor handling property. The length of the stainless steel short fibers is preferably in the range of 100 mm to 800 mm. If the short fiber length is too small, the frequency of contact of the stainless steel short fibers is reduced and thus a uniform and stable electrical resistance cannot be obtained. If the short fiber length is too large, contact resistance among the stainless steel short fibers is undesirably reduced and the efficiency of heat-generation is lowered.

The heat-resistant electrically non-conductive fibers having a limited length, which form the flexible heat-generating mixed spun yarn together with the stainless steel fibers of a limited length, have a volume resistivity of at least $10^{12}$ ohm.cm and are selected from usual synthetic fibers, regenerated fibers and natural fibers. Of these, an aromatic polyamide fiber is preferable because of its high heat-resistance.

The flexible heat-generating mixed spun yarn is preferably composed of 20 to 80% by weight of the stainless steel short fibers and 80 to 20% by weight of the heat-resistant electrically non-conductive short fibers. If the proportion of the stainless steel short fibers is too small, the amount of heat-generation is insufficient for the road heater. If the proportion of the stainless steel fibers are too large, the electrical resistance is greatly reduced and the amount of heat-generation becomes too large. The flexible heat-generating mixed spun yarn comprising the stainless steel short fibers and the heat-resistant electrically non-conductive short fibers in the above-mentioned proportion usually has an electrical resistance of 0.05 to 10 ohm/cm which is a level suitable for a road heater, and further has a good flexibility and a high strength, as compared with a nichrome wire and a carbon heating element.

Figure 3:
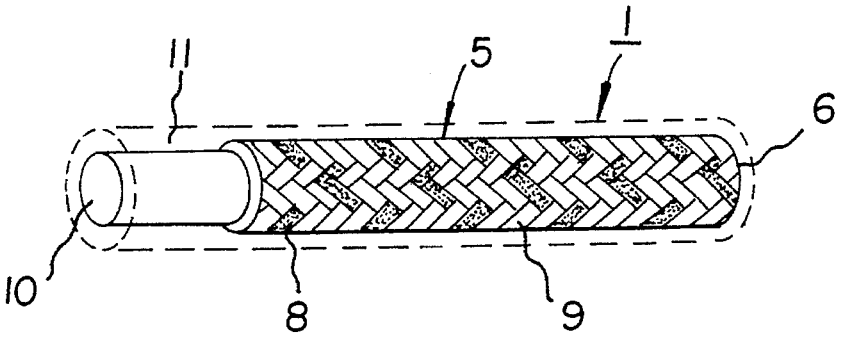
FIG. 3 is a perspective view of one example of the linear heating element contained in the linear heater of the road heater of the present invention.

The flexible heat-generating mixed spun yarn is preferably made by a procedure using an apparatus shown in FIG. 3 in Japanese Unexamined Patent Publication No. 62-22386. Namely, a bundle of continuous stainless steel filaments is spread to a broad width and a bundle of continuous electrically non-conductive filaments is spread to a broad width, and the two filament bundles are superposed upon another. The superposed filament bundles are drafted between feed rollers and drafting rollers rotating at a rate much faster than the feed rollers, whereby at least the continuous stainless steel filaments, usually both of the continuous stainless steel filaments and the continuous heat-resistant electrically non-conductive filaments are stretch-cut into short lengths. The average fiber lengths of the stainless steel short fibers and the heat-resistant electrically non-conductive short fibers vary depending upon the particular distance between the feed rollers and the drafting rollers. The thickness of the flexible heat-generating mixed spun yarn varies depending upon the particular ratio of the rate of the drafting rollers to the rate of the feed rollers. Then the bundle of the stainless steel short fibers combined with the heat-resistant electrically non-conductive short fibers is preferably subjected to a compressed air-treatment by passing the fiber bundle through a compressed air-ejecting nozzle whereby a good bundling property is imparted to the fibers. The compressed air-ejecting nozzle is, for example, a type wherein compressed air is revolved or a type wherein the fibers are entangled with each other.

Figure 4:
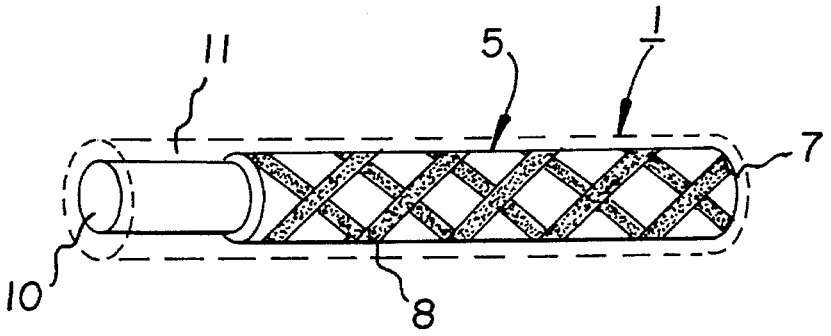
FIG. 4 is a perspective view of another example of the linear heating element contained in the linear heater of the road heater of the present invention.
Figure 5:
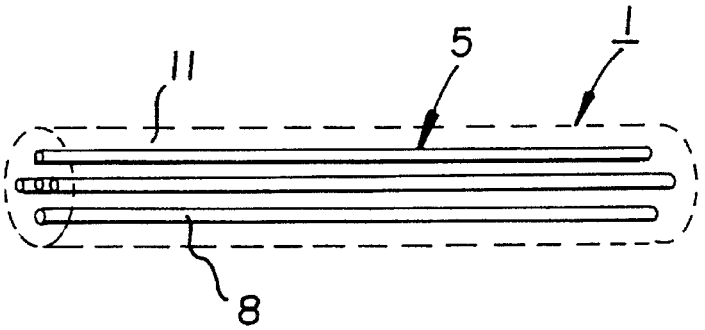
FIG. 5 is a perspective view of still another example of the linear heating element contained in the linear heater of the road heater of the present invention.

The flexible heat-generating mixed spun yarn can be used, for example, (1) in the form of a braid, a woven or knitted fabric or another textile structure which is fabricated from the flexible heat-generating mixed spun yarn 8 alone as illustrated in FIG. 4, or from a combination of the flexible heat-generating mixed spun yarn 8 with a flexible heat-resistant electrically non-conductive yarn 9 composed of a heat resistant fiber as illustrated in FIG. 3, which is formed on the periphery of a continuous flexible core material 10 such as heat-resistant rubber or a thermoplastic resin, so that the entirely periphery of the continuous flexible core material 10 is covered with the textile structure, or (2) in the form of a single yarn composed of the flexible heat-generating mixed spun yarn 8 (not shown) or a paralleled yarn composed of two or more of the flexible heat-generating mixed spun yarn 8 as illustrated in FIG. 5. These forms of the flexible heat-generating mixed spun yarn are not shown in FIG. 1.

Of the textile materials, a braid which is fabricated from the flexible heat-generating mixed spun yarn alone or from a combination of the flexible heat-generating mixed spun yarn with a flexible heat-resistant electrically non-conductive yarn, is preferable because the fabrication of the braid and the formation of the covering for the continuous flexible core material can be simultaneously effected.

The flexible heat-resistant electrically non-conductive yarn optionally used for the formation of the braid or other textile material together with the flexible heat-generating mixed spun yarn is made of a fiber which is capable of being resistant to heat generated by the heat-generating mixed spun yarn and which is selected from synthetic fibers, regenerated fibers and natural fibers, and is preferably a synthetic fiber such as a polyester or polyamide fiber.

The continuous flexible core material, on the periphery of which a textile material comprising the flexible heat-generating mixed spun yarn is formed, is selected from flexible heat-resistant materials such as a heat-resistant rubber, e.g., a chloroprene rubber and an ethylene-propylene rubber, and a thermoplastic resin, e.g., polyvinyl chloride, polyethylene or polypropylene. The continuous flexible core material may have incorporated therein an additive, provided that the flexibility and the heat resistance are not injured, which includes, for example, a flame retardant, a modifier, a light-stabilizer, a heat building-up agent or a far-infrared ray generator. The shape of cross-section of the continuous flexible core material used in the above (1) is not particularly limited and is, for example, circular, polygonal, elliptic or hollow.

To ensure the electrical insulation of the linear heater 1 and the protection thereof, a flexible electrically insulating layer is formed between the linear heater 1 and the outer textile structure 2 (the flexible electrically insulating layer is not shown in FIG. 1). The flexible electrically insulating layer is made of a flexible electrically non-conductive thermoplastic resin or rubbery material.

The flexible electrically insulating layer may have incorporated therein an additive, provided that the flexibility and the heat insulation are not injured, which includes, for example, a flame retardant, a modifier, a light-stabilizer, a heat building-up agent or a far-infrared ray generator.

Where the linear heating element is, for example, a nichrome wire heating element, a carbon heating element, or a flexible heat-generating mixed spun yarn composed of stainless steel fibers and heat-resistant electrically non-conductive fibers which is in the form of a braid, a woven or knitted fabric or another textile structure, the electrically non-conductive layer is formed on the periphery of the linear heating element. Where the linear heating element is, for example, a single flexible heat-generating mixed spun yarn or a paralleled yarn composed of two or more flexible heat-generating mixed spun yarns, the linear heating element is covered with the electrically insulating layer so that the linear heating element is embedded therein.

Referring to FIG. 1, the outer textile structure 2 such as a braid covering the periphery of the linear heater 1 must have a melting point of at least 200° C. and a single fiber fineness of at least 1,000 deniers. If the melting point is lower than 200° C., the textile structure 2 is liable to be damaged when the roadbed is paved with a molten asphalt composition, and thus, the outer textile structure becomes incapable of protecting the linear heater 1. If the fiber has a single fiber fineness smaller than 1,000 deniers, the compressive yield load (Lc) of the road heater is low. However, if the fiber has a too large single fiber diameter, the handling properties become poor, and therefore, the fiber preferably has a single fiber fineness of not larger than about 5,000 deniers. As specific examples of the thermoplastic synthetic fiber, there can be mentioned a polyester fiber, a polyamide fiber and a polyether-sulfone fiber. Especially, a polyester monofilament is preferable.

The outer textile structure 2 covers the periphery of the linear heater 1 in a way such that the thermoplastic synthetic fibers such as monofilaments are spirally wound or cylindrically knitted continuously without a break in the form of, for example, a braid, a woven or knitted fabric the like on the entire periphery of the linear heater 1.

The road heater of the present invention must have a compressive yield load (Lc) of at least 1,000 kg. By the term "compressive yield load (Lc)"used herein we mean a minimum load at which damage of the road heater occurs when a compressive load is applied to the heater so that it is distorted in the radial direction thereof. The larger the compressive yield load (Lc), the larger the resistance of the heater to the compressive force. However, if the Lc is too large, the flexibility of the road heater is liable to be lost. Thus, the compressive yield load (Lc) should preferably be not larger than about 2,000 kg.

The installation of the road heater of the present invention for road-heating can be effected by laying the road heater in any desired configuration on the concrete roadbed in the ground and paving the heater-laid roadbed with an asphalt concrete composition. Therefore, a high road strength can be obtained. When the roadbed is paved, the asphalt concrete composition maintained at a temperature of 180° C. to 190° C. and laid on the roadbed can be leveled by a finisher and pressed and smoothed by a macadam roller or a tire roller. Thus, the strength of the road surface can be enhanced as compared with the strengths as obtained with the conventional road heaters.

That is, as the periphery of the road heater of the present invention is covered with a heat-resistant textile structure, the road heater-laid roadbed can be paved with an asphalt concrete composition maintained at a high temperature as it is without cooling. Further, as the road heater has a high compressive yield load, the road heater is neither broken nor damaged when rolled, e.g., by a tire roll. These benefits lead to enhancement of strength of the road surface.

Figure 2:
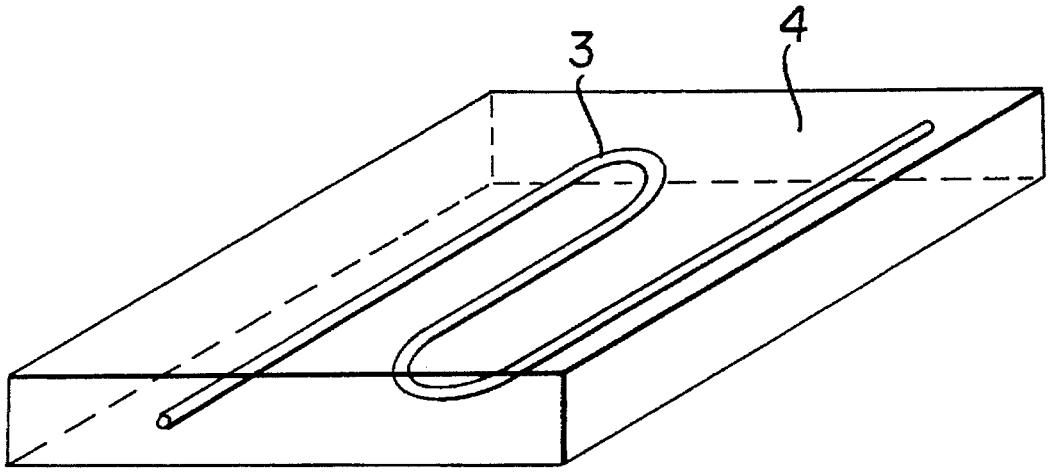
FIG. 2 is a perspective view of a concrete block for melting and removing snow, in which the road heater of the present invention is embedded.

In another embodiment of installing the road heater of the present invention in a road, the road heater is embedded in concrete blocks, and the concrete block are laid in a road. Namely, as illustrated in FIG. 2, a plurality of the road heaters 3 are connected in series, and the connected road heaters are embedded in a mortar to make a heat-storage mortar block 4. A plurality of the mortar blocks 4 are laid on a road while the road heaters of the blocks are electrically connected. Where the road heaters are installed according to this embodiment, the outer textile structure covering the linear heater can be omitted.

According to a preferred embodiment of the present invention wherein the flexible heat-generating mixed spun yarn composed of 20 to 80 weight % of stainless steel short fibers and 80 to 20 weight % of heat-resistant electrically non-conductive short fibers as the linear heating element is used in the form of a braid, a woven or knitted fabric or another textile structure which is formed on the periphery of a continuous flexible core material, so that the entire periphery of the continuous flexible core material is covered with the textile structure, the following advantages are obtained.

(i) Since the textile structure comprising the flexible heat-generating mixed spun yarn is formed uniformly on the entire periphery of a continuous flexible core material, heat generated from the heat-generating spun yarn can be spread uniformly over the entire periphery of the linear heater. The density of heat generation can be varied voluntarily by changing the distance between the adjacent heat-generating spun yarns disposed on the periphery of a continuous core material.

(ii) Since the textile structure comprising the heat-generating yarn is continuously wound around a continuous flexible core material, when a compressive stress is repeatedly applied, the compressive stress can absorbed by the entire textile structure. Thus even when the road heater is bent at a large curvature, the heat-generating yarn is distorted not to a large extent and can be laid at any desired configuration on the roadbed. The durability against repeated compression and bending is high.

(iii) The heat-generating yarn generally has a high strength and the stress applied can be absorbed by the entire textile structure. Therefore the thickness of the textile structure can be thin and thus the road heater has an enhanced flexibility.

(iv) Since the textile structure comprising the heat-generating yarn is formed on the periphery of a continuous flexible core material, the generated heat is dispersed radially from the entire periphery of the linear heater and thus the heating area is large and the heat loss is small.

The road heater of the present invention will now be specifically described by the following examples.

In the examples, the compressive yield load (Lc) was determined as follows. A heater testing sample having a length of 2 cm was heat-treated at a temperature of 65° C. for 60 minutes under dry heat conditions. A compressive force was applied to the heat-treated sample so that the sample is distorted in the radial direction, by using a Tensilon tensile compressive tester. The minimum load (Lc) at which damage of the road heater commenced was measured at room temperature, i.e., 25° C.

EXAMPLE 1

5,000 continuous filaments made of copoly-p-phenylene-3,4'-oxydiphenylene-terephthalamide and having a single filament fineness of 1.5 deniers (tradename "Technora"supplied by Teijin Ltd.) were combined with 900 continuous filaments made of stainless steel and having a single filament diameter of 12 μm. A bundle of the combined filaments were drafted between feed rollers and drafting rollers which were located at a distance of 1,000 mm from the feed rollers and were rotated at a peripheral speed 30 times of that of the feed rollers, whereby at least the continuous stainless steel filaments were stretch-cut into a short length. Then the bundle of the combined filaments were passed through an air-revolving nozzle wherein compressed air was revolved at a pressure of 3 kg/cm$^2$, whereby a good bundling property was imparted to the filaments, to give a mixed spun yarn composed of fibers having an average length of about 310 mm and containing 50% by weight of stainless steel fibers.

A first twist of (Z) 500T/m was given to the mixed spun yarn, and the twisted mixed spun yarn was fabricated into a braid around a columnar heat-resistant polyvinyl chloride core material having a circular cross-section with a diameter of 4 mm. Namely, while two of the twisted mixed spun yarn were fed to a bobbin and two of the twisted mixed spun yarn were fed to another bobbin rotating in an opposite direction, a braid was fabricated from the four yarns on the periphery of the columnar heat-resistant polyvinyl chloride core material. The thus-obtained composite linear heating element was covered with a tube of heat-resistant polyvinyl chloride to form a linear heater having an outer diameter of 8.5 mm.

Then, while 24 polyester monofilaments having a single filament fineness of 2,300 deniers were fed to a bobbin and 24 polyester monofilaments having a single filament fineness of 2,300 deniers were fed to another bobbin rotating in an opposite direction, a braid as an outer textile structure was fabricated from the polyester monofilaments on the periphery of the above-mentioned linear heater, whereby a road heater was obtained.

The road heater had a compressive yield load (Lc) of 2,350 kg 12 cm.

The road heater was laid in parallel in a square area having a length of 10 m and a width of 2 m on the roadbed in the ground so that the power supply was 250 W/m$^2$. The heater-laid roadbed was paved with an asphalt concrete composition maintained at 190° C. at a thickness of 8 cm, and then the asphalt concrete-paved surface was pressed and smoothed by a roller. The road heater was neither broken nor damaged during the pavement. The time required for the completion of pavement (which means the time spanning from the starting of pavement of the heater-laid roadbed with the asphalt composition to the completion of pressing and smoothing by a roller) were 18 minutes.

As another example of laying the road heaters in a road, a procedure will now be described by which the road heaters in the form of heat-storage mortar blocks are laid. Namely, a plurality of the road heaters were connected in series as illustrated in FIG. 2 so that the power supplied was 18 W, and the connected road heaters were embedded in a mortar to make a heat-storage mortar block having a size of 30 cm×30 cm×5 cm. A plurality of the heat-storage blocks were laid in each of temperature controlled baths maintained at an atmosphere temperature of 0° C. and −5° C. After an electric current was applied for 3 hours and thus the temperature was stabilized, the internal temperature of the block and the surface temperature thereof were measured. The results are shown in Table 1.

Nine of the heat-storage blocks were laid in a road in the Osaka Research Center of Teijin Limited of 4-1, Minohara 3-chome, Ibaraki-shi, Osaka, Japan. When 6 months elapsed, number of breakage of the heating elements was examined. The results are shown in Table 1.

EXAMPLE 2

A road heater was made by the same procedure as that described in Example 1 and installed in the road, except that 24 paralleled yarns each composed of three polyester monofilaments having a single filament fineness of 1,000 deniers were used instead of 24 polyester monofilaments having a single filament fineness of 2,3300 deniers for the fabrication of a braid as an outer textile structure on the linear heater.

The resultant road heater had a compressive yield load (Lc) of 1,480 kg 12 cm. The time required for the completion of pavement was 19 minutes.

Comparative Example 1

A road heater was made by the same procedure as that described in Example 1 except that fabrication of the braid from the polyester monofilament yarns was not conducted.

The resultant road heater had a compressive yield load (Lc) of 750 kg 12 cm. When the road heater was laid on the roadbed in the earth and the heater-laid roadbed was paved with an asphalt concrete composition in a manner similar to that in Example 1, the heater was damaged and the electrical insulation property was deteriorated. Thus the heater was of no practical use as a road heater.

Comparative Example 2

The same heater as that made in Comparative Example 1 was laid on the roadbed in the earth and the heater-laid roadbed was paved with an asphalt mortar composition maintained at 190° C. After the laid asphalt mortar composition was allowed to cool to 120° C., the asphalt mortar composition-laid surface was pressed and smoothed manually by a roller. The time required for the completion of pavement was 65 minutes.

EXAMPLE 3

A road heater was made by the same procedure as that described in Example 1 and installed in the road, except that the braid of the flexible heat-generating mixed spun yarn was fabricated was fabricated as follows with all other conditions remaining the same. Namely, a first twist of (Z) 500T/m was given to the mixed spun yarn, and two of the first-twisted yarn were doubled and a second twist of (S) 355T/m was given thereto. While two of the second-twisted yarn and two of polyethylene terephthalate multifilament yarn having a total fineness of 1,000 deniers were fed to a bobbin and four of polyethylene terephthalate multifilament yarn having a total fineness of 1,000 deniers were fed to another bobbin rotating in an opposite direction, a braid was fabricated from the eight yarns on the periphery of the heat-resistant polyvinyl chloride core material.

The resultant road heater had a compressive yield load (Lc) of 1,950 kg 12 cm. The time required for the completion of pavement was 19 minutes.

Heat-storage mortar blocks having the road heaters embedded therein were made and evaluated by the same procedures as those described in Example 1. The results are shown in Table 1.

EXAMPLE 4

A road heater having a nichrome heating element was made by a conventional procedure wherein a nichrome wire having a diameter of 1.5 mm was covered with the same heat-resistant polyvinyl chloride tube as that used in Example 1 to yield a linear heater having an outer diameter of 8.5 mm. On the periphery of this linear heater, a braid as an outer textile structure was fabricated from polyester monofilaments by the same procedure as that described in Example 1, whereby a road heater was obtained.

The road heater had a compressive yield load (Lc) of 1,200 kg 12 cm. The time required for the completion of pavement was 20 minutes.

Heat-storage mortar blocks having the road heaters embedded therein were made and evaluated by the same procedures as those described in Example 1. The results are shown in Table 1.

EXAMPLE 5

A road heater having a carbon heating element was made by a conventional procedure wherein a carbon-coated heating element having an outer diameter of 5 mm was covered with the same heat-resistant polyvinyl chloride tube as that used in Example 1 to yield a linear heater having an outer diameter of 8.5 mm. On the periphery of this linear heater, a braid as an outer textile structure was fabricated from polyester monofilaments by the same procedure as that described in Example 1, whereby a road heater was obtained.

The road heater had a compressive yield load (Lc) of 1,100 kg 12 cm. The time required for the completion of pavement was 21 minutes.

Heat-storage mortar blocks having the road heaters embedded therein were made and evaluated by the same procedures as those described in Example 1. The results are shown in Table 1.

TABLE 1

| | Example 1 | Example 3 | Example 4 | Example 5 |
|---|---|---|---|---|
| At bath temp. of 0° C. | | | | |
| Internal temp. (°C.) | 12.1 | 11.8 | 9.7 | 9.8 |
| Surface temp. (°C.) | 7.8 | 7.8 | 6.2 | 5.3 |
| At bath temp. of −5° C. | | | | |
| Internal temp. (°C.) | 7.9 | 7.7 | 5.7 | 5.4 |
| Surface temp. (°C.) | 2.6 | 2.5 | 2.3 | 2.0 |
| No. of breakage of heating element | 0 | 0 | 3 | 4 |

EXAMPLE 6

A twisted mixed spun yarn containing stainless steel fibers, which yarn was the same as that made in Example 1, was prepared. Eight of the twisted mixed yarn were combined together to form a paralleled yarn. The paralleled yarn was covered with the same heat-resistant polyvinyl chloride tube as that used in Example 1 to form a linear heater having an outer diameter of 8.5 mm. On the periphery of this linear heater, a braid as an outer textile structure was fabricated from polyester monofilaments by the same procedure as that described in Example 1, whereby a road heater was obtained.

The road heater had a compressive yield load (Lc) of 2,150 kg 12 cm. The time required for the completion of pavement was 19 minutes.

As substantiated in the examples and comparative examples, when the road heater of the present invention is used, an asphalt concrete composition maintained at a high temperature can be spread over the heater-laid roadbed as it is at the high temperature, and further, the spread asphalt concrete composition can be pressed and smoothed by a roller as it is at the high temperature. Therefore, the strength of the surface portion of road can be enhanced as compared with the strengths as obtained with conventional road heaters. Further, the pavement of the road heater-laid roadbed with an asphalt concrete composition can be completed within a short time.

As seen from Table 1, a road heater having a linear heating element comprising a stainless steel fiber-containing flexible heat-generating mixed spun yarn (Examples 1 and 3) is advantageous over a road heater having a nichrome wire heating element or a carbon heating element (Examples 4 and 5). Namely, the former road heater is not damaged When an external force is applied or the heater is deformed, and thus, its durability after embedded in a road is much better than that of the latter road heater.

I claim:

1. A road heater, comprising:

(1) a linear heater which is comprised of a linear heating element and a flexible electrically insulating layer formed on the entire periphery of the linear heating element, and (2) an outer textile structure which covers the entire periphery of the linear heater; said road heater having a compressive yield load (Lc) of at least 1,000 kg; and said outer textile structure is made of a thermoplastic synthetic fiber having a melting point of at least 200° C. and a single fiber fineness of at least 1,000 deniers;

wherein the linear heating elements comprises a flexible heat-generating mixed spun yarn which is composed of 20 to 80 weight % of stainless steel fibers having a limited length and 80 to 20 weight % of heat-resistant electrically non-conductive fibers and which is capable of generating heat due to contact resistance among the stainless steel fibers when an electric current is applied thereto.

2. A road heater as claimed in claim 1, wherein the linear heating element comprises the flexible heat-generating mixed spun yarn and a flexible continuous core material; said flexible heat-generating mixed spun yarn is in the form of a braid which is formed on the periphery of the flexible continuous core material and which is fabricated from the flexible heat-generating mixed spun yarn alone or from a combination of the flexible heat-generating mixed spun yarn with a flexible heat-resistant electrically non-conductive yarn.

3. A road heater as claimed in claim 1, wherein the linear heating element is in the form of a single yarn composed of said flexible heat-generating mixed spun yarn, or a paralleled yarn composed of two or more of said flexible heat-generating mixed spun yarn; and said heating element being embedded in said flexible electrically insulating layer.

4. A road heater as claimed in claim 1, wherein the stainless steel fibers have a volume resistivity of $10^{-5}$ to $10^{-6}$ ohm.cm, a diameter of 4 to 30 μm, and an average fiber length of 100 mm to 800 mm.

5. A road heater as claimed in claim 1, wherein the heat-resistant electrically non-conductive fibers have a volume resistivity of at least $10^{12}$ ohm.cm.

6. A road heater as claimed in claim 1, wherein the flexible heat-generating mixed spun yarn has an electrical resistance of 0.05 to 10 ohm/cm.

7. A road heater as claimed in claim 1, wherein the flexible electrically insulating layer is composed of a heat-resistant rubber or thermoplastic resin.

8. A road heater as claimed in claim 1, wherein the thermoplastic synthetic fiber is a polyester monofilament.

9. A road heater as claimed in claim 1, wherein the outer textile structure is a braid fabricated from the thermoplastic synthetic fiber.

* * * * *